US010161086B2

(12) United States Patent
McNeeley et al.

(10) Patent No.: US 10,161,086 B2
(45) Date of Patent: Dec. 25, 2018

(54) ILLUMINATED PAVER

(71) Applicant: Nottingham-Spirk Design Associates, Inc., Cleveland, OH (US)

(72) Inventors: Carolyn Marie McNeeley, University Heights, OH (US); Nick Stanca, Westlake, OH (US); James Edward Szpak, Cleveland Heights, OH (US); Gary R. Stephan, Seven Hills, OH (US); Rich Klink, Berea, OH (US); Alex Velet, Westlake, OH (US)

(73) Assignee: Alpha International, Inc., Cedar Rapids, IA (US)

( * ) Notice: Subject to any disclaimer, the term of this patent is extended or adjusted under 35 U.S.C. 154(b) by 174 days.

(21) Appl. No.: 15/278,671

(22) Filed: Sep. 28, 2016

(65) Prior Publication Data

US 2018/0087225 A1 Mar. 29, 2018

(51) Int. Cl.

| | |
|---|---|
| ***E01C 17/00*** | (2006.01) |
| ***F21V 27/00*** | (2006.01) |
| ***E01C 5/20*** | (2006.01) |
| ***F21V 33/00*** | (2006.01) |
| *F21V 23/00* | (2015.01) |

(Continued)

(52) U.S. Cl.

CPC ..... *E01C 17/00* (2013.01); *E01C 5/20* (2013.01); *F21V 27/00* (2013.01); *F21V 33/006* (2013.01); *F21S 2/00* (2013.01); *F21V 7/0083* (2013.01); *F21V 21/0824* (2013.01); *F21V 23/001* (2013.01); *F21V 23/008* (2013.01); *F21V 31/005* (2013.01); *F21W 2121/00* (2013.01);

(Continued)

(58) Field of Classification Search

CPC ..... E01C 17/00; E01C 2201/00; E01C 5/20; F21V 21/0824; F21V 7/0025; F21V 31/005; F21V 23/008; F21V 27/00; F21V 23/06; F21V 23/001; F21V 33/006; F21V 7/0083; F21W 2121/00; F21W 2131/10; F21Y 2115/10; F21S 2/00

USPC ..... 362/235, 153, 153.1

See application file for complete search history.

(56) References Cited

U.S. PATENT DOCUMENTS

| | | | | |
|---|---|---|---|---|
| 3,775,918 A | | 12/1973 | Johnson | |
| 4,697,950 A | * | 10/1987 | Copeland | E01C 17/00 116/63 R |

(Continued)

FOREIGN PATENT DOCUMENTS

| | | | |
|---|---|---|---|
| CA | 2482519 | | 3/2006 |
| CN | 201314110 Y | * | 9/2009 |

(Continued)

*Primary Examiner* — Anh Mai
*Assistant Examiner* — Glenn Zimmerman
(74) *Attorney, Agent, or Firm* — Rankin, Hill & Clark LLP

(57) ABSTRACT

An illuminated paver comprises a body including a top part having a decorative outer surface and a separate bottom part attached to the top part. The body houses a light source to be electrically connected to an associated external power source. An inner surface of at least one of the top part and the bottom part includes a plurality of strengthening ribs extending between the top and bottom parts of the body. The strengthening ribs are configured to reflect light emitted from the light source so as to randomly disperse light passing through the decorative outer surface. An electrical cord wrap is provided on an outer surface the bottom part and includes a plurality of cord receiving recesses.

19 Claims, 12 Drawing Sheets

(51) Int. Cl.

| | |
|---|---|
| *F21V 21/08* | (2006.01) |
| *F21V 31/00* | (2006.01) |
| *F21W 121/00* | (2006.01) |
| *F21W 131/10* | (2006.01) |
| *F21S 2/00* | (2016.01) |
| *F21V 7/00* | (2006.01) |
| *F21Y 115/10* | (2016.01) |

(52) U.S. Cl.
CPC ..... *F21W 2131/10* (2013.01); *F21Y 2115/10* (2016.08)

(56) References Cited

U.S. PATENT DOCUMENTS

| | | | | |
|---|---|---|---|---|
| 4,992,914 | A * | 2/1991 | Heiss | E01C 17/00 362/153.1 |
| 5,184,792 | A | 2/1993 | Bernhard et al. | |
| 6,027,280 | A | 2/2000 | Conners et al. | |
| 6,082,886 | A | 7/2000 | Stanford | |
| 6,116,751 | A * | 9/2000 | Remp | E01C 17/00 362/153 |
| 7,131,761 | B2 | 11/2006 | Pipo et al. | |
| D547,480 | S * | 7/2007 | Cnossen | D26/74 |
| 7,344,334 | B2 | 3/2008 | Thorkelson | |
| 7,358,929 | B2 | 4/2008 | Mueller et al. | |
| 8,235,542 | B2 * | 8/2012 | Yohananoff | E01C 17/00 362/153 |
| 9,226,370 | B2 | 12/2015 | Berkvens et al. | |
| 2006/0082989 | A1 | 4/2006 | Wang | |
| 2006/0231131 | A1 | 10/2006 | Hain | |
| 2006/0291196 | A1 | 12/2006 | Benavente | |
| 2011/0013384 | A1 * | 1/2011 | Lu | F21S 8/022 362/183 |
| 2012/0262911 | A1 * | 10/2012 | Schweizer | F21V 33/006 362/183 |
| 2014/0225526 | A1 | 8/2014 | Jonsson | |
| 2014/0285113 | A1 | 9/2014 | Huang | |

FOREIGN PATENT DOCUMENTS

| | | |
|---|---|---|
| EP | 1574778 | 9/2005 |
| GB | 2387185 | 10/2003 |
| GB | 2397872 | 8/2004 |
| WO | 95/09277 | 4/1995 |
| WO | 2007/013121 | 2/2007 |

* cited by examiner

ILLUMINATED PAVER

BACKGROUND

Pavers are popular components frequently used in landscaping and outdoor construction and can be installed abutted or in quantity covering large areas and installed individually to form a narrow pathway or walkway. Typically, pavers are designed to be attractive in appearance and functional, and it is often desirable and sometimes necessary to provide lighting for the pavers. The most common method of lighting a surface of the paver is to use light fixtures, such as lamp posts, designed to cast light onto the surface for aesthetic and safety reasons. However, the light cast from a fixture may only illuminate a portion of the surface immediately adjacent to the fixture and may not sufficiently light the entire surface. To this end, it is known to incorporate light sources into pavers. However, existing illuminated pavers can be cumbersome to install and maintain where the light source must be connected to an external power source. The present disclosure relates to an improved outdoor illuminated paver to create an illuminated pathway in a yard, a garden, alongside a driveway, deck or on any substantially flat or level walking surface.

SUMMARY

According to one aspect, an illuminated paver comprises a body including a top part having a decorative outer surface and a separate bottom part attached to the top part. The body houses a light source to be electrically connected to an associated external power source. An inner surface of at least one of the top part and the bottom part includes a plurality of strengthening ribs extending between the top and bottom parts of the body. The strengthening ribs are configured to reflect light emitted from the light source so as to randomly disperse light passing through the decorative outer surface.

According to another aspect, an illuminated paver comprises a body including a top part having a decorative outer surface and a separate bottom part attached to the top part. The body houses a light source. An electrical cord at least partially housed in the body electrically connects the light source to an associated external power source. A cord wrap is provided on an outer surface of the bottom part and includes a plurality of recesses for selectively receiving the electrical cord.

According to yet another aspect, an illuminated paver system comprises a first illuminated paver including a body including a decorative top surface and a bottom surface. A light source is housed in the body. A plurality of internal strengthening ribs extends between the top and bottom surfaces of the body. The strengthening ribs are configured to reflect light emitted from the light source so as to randomly disperse light passing through the decorative top surface. An electrical cord is at least partially housed in the body for electrically connecting the first paver to an associated external power source and a second illuminated paver. A cord wrap including a plurality of recesses is provided on the bottom surface for selectively receiving the electrical cord thereby allowing for adjustment of a distance between the first and second pavers.

DETAILED DESCRIPTION

Figure 1:
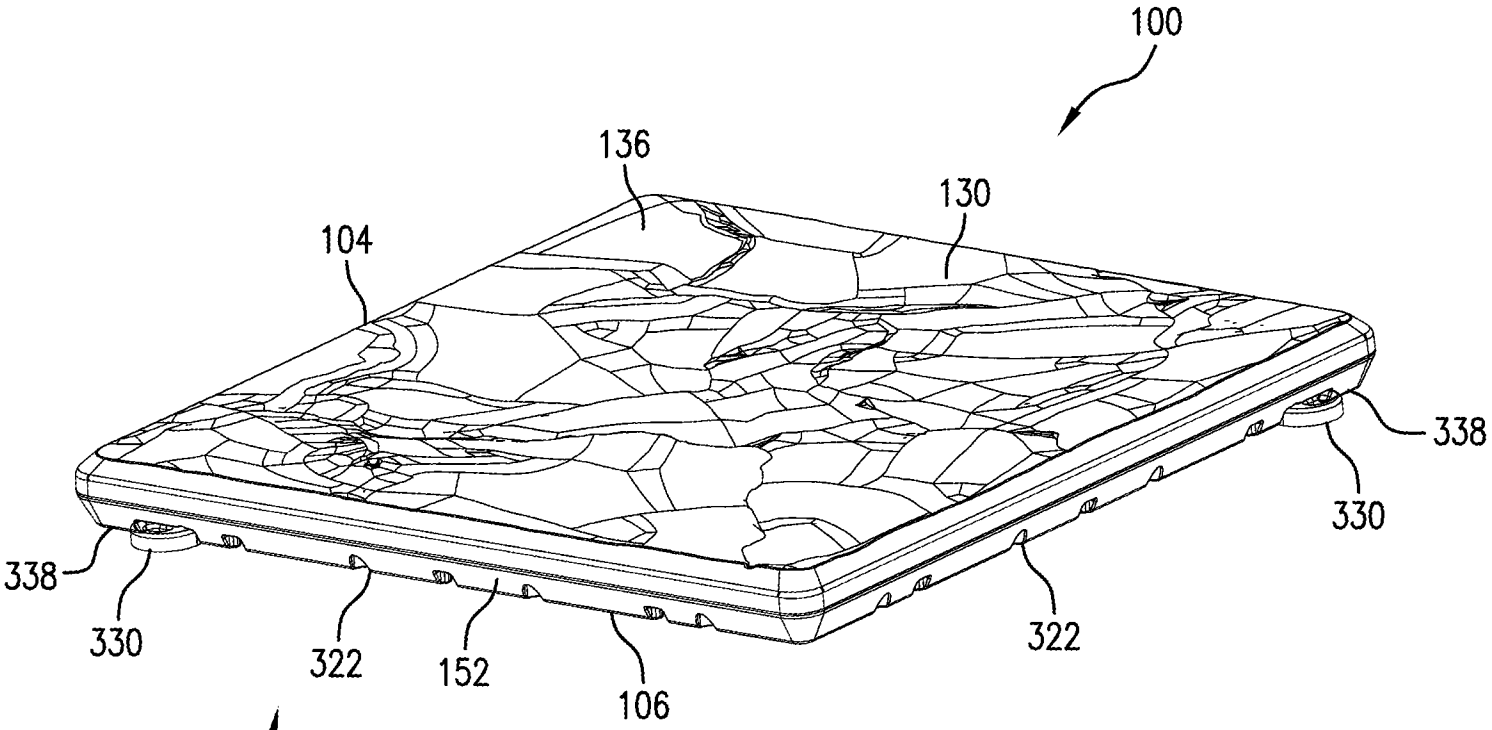
FIG. 1 is a perspective view of an exemplary illuminated paver according to the present disclosure.
Figure 2:
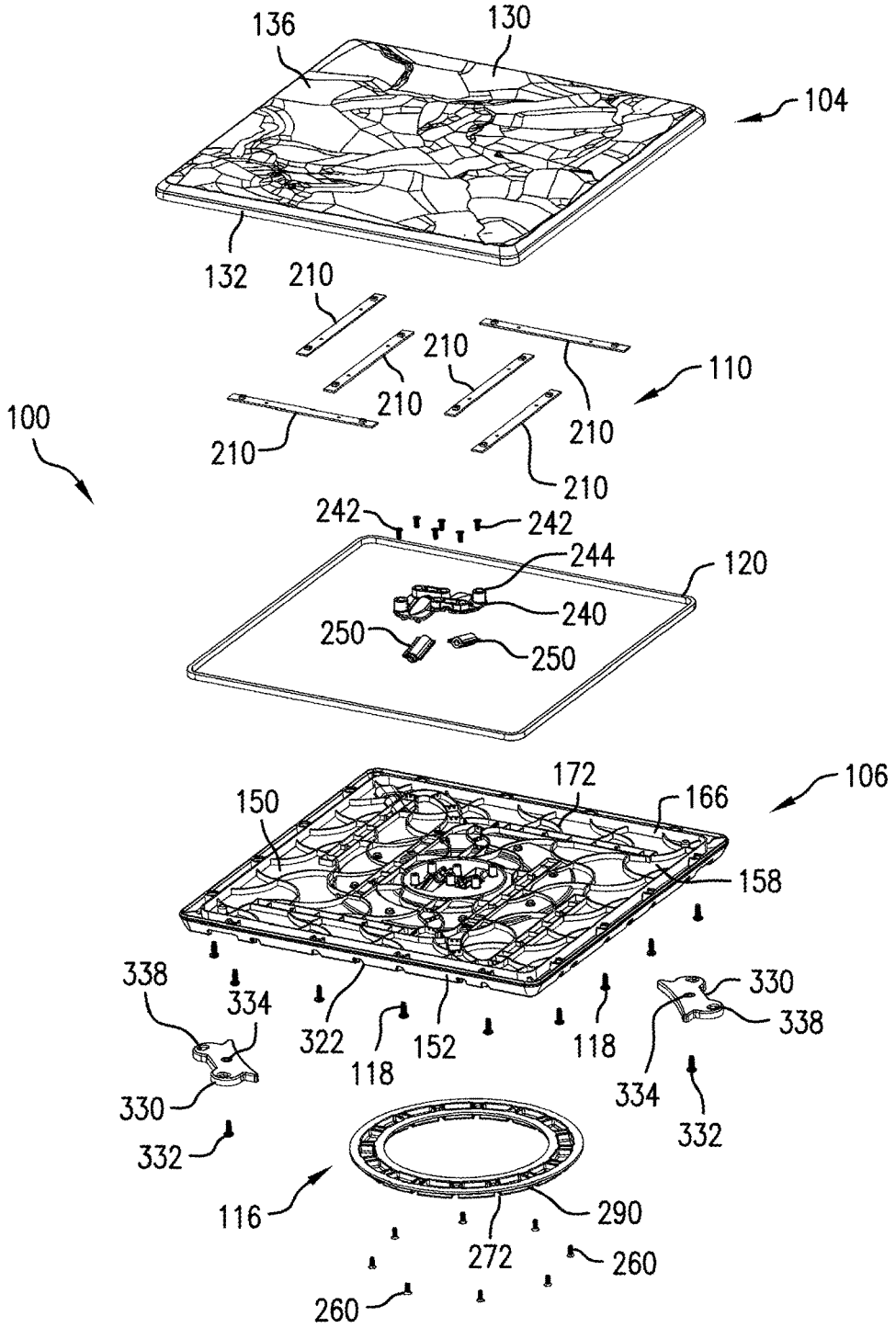
FIGS. 2 and 3 are exploded perspective views of the paver of FIG. 1.
Figure 3:
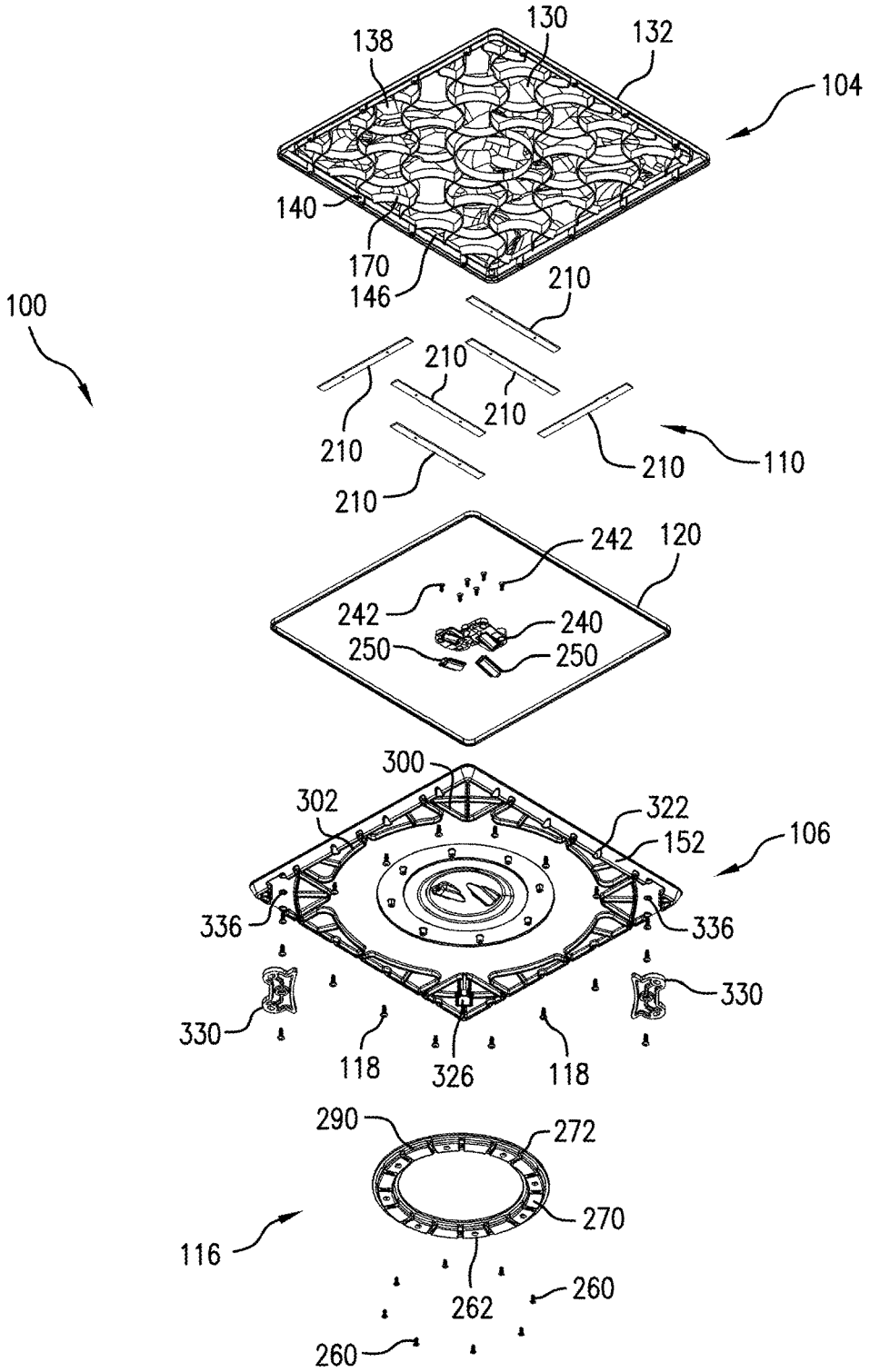

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1-3 illustrate an exemplary illuminated paver 100 according to the present disclosure. The paver 100 generally comprises a body 102 having a top part 104 and a bottom part 106. At least one light source 110 is housed in the body 102 to be electrically connected to an associated external electrical power source 112 via electrical wiring (e.g., electrical cord 114) (see FIG. 11). An electrical cord wrap 116 is provided on the bottom part 106. In the present embodiment, the bottom part 106 is separate from the top part 104 and is attached to the top part 104 via suitable fasteners 118 (e.g., screws). However, it should be appreciated that alternative manners for attaching the top and bottom parts 104, 106 are contemplated. For example, one of the top part 104 and bottom part 106 can be provided with engagement tabs which are received in corresponding openings located in the other of the top part 104 and bottom part 106. A gasket 120 or other sealing means is located between the top and bottom parts 104, 106 to minimize the possibility of ground water and/or debris from entering into the body 102 and interacting with the electrical connection of the light source 110.

The top part 104 includes base 130 and a side wall 132 extending about a perimeter of the base 130. The base 130 has an outer or top surface 136, which can have a decorative non-slip finish to simulate natural stone in daylight, and an inner surface 138. The top surface 136 is at least partially transparent to allow light emitted from the light source 110 to pass through. Spaced mounting bosses 140 are arrayed along an inner surface 142 of the side wall 132 and are adapted to be threadingly engaged by the fasteners 118. A mounting flange 146 for the gasket 120 is spaced inwardly from the mounting bosses 140 and extends along an entirety of the side wall 132. The bottom part 106 includes a base 150 and a side wall 152 extending about a perimeter of the base 150. The base 150 has an outer or bottom surface 156 and an inner surface 158. Located on the base 150 are spaced mounting apertures 160 which correspond in location with the mounting bosses 140. A mounting flange 166 for the gasket 120 is spaced inwardly from and extends along an entirety of the side wall 152.

A plurality of strengthening ribs extend between the top part 104 and the bottom part 106 of the body 102. The strengthening ribs provide rigidity to the paver 100, which is generally hollow to accommodate the at least one light source 110, so that the paver 100 can support a person standing and/or walking on the paver. In addition, the strengthening ribs are configured to reflect and refract light emitted from the light source 110 so as to randomly disperse and diffuse light passing through the decorative outer surface 136 of the top part 104.

Figure 4:
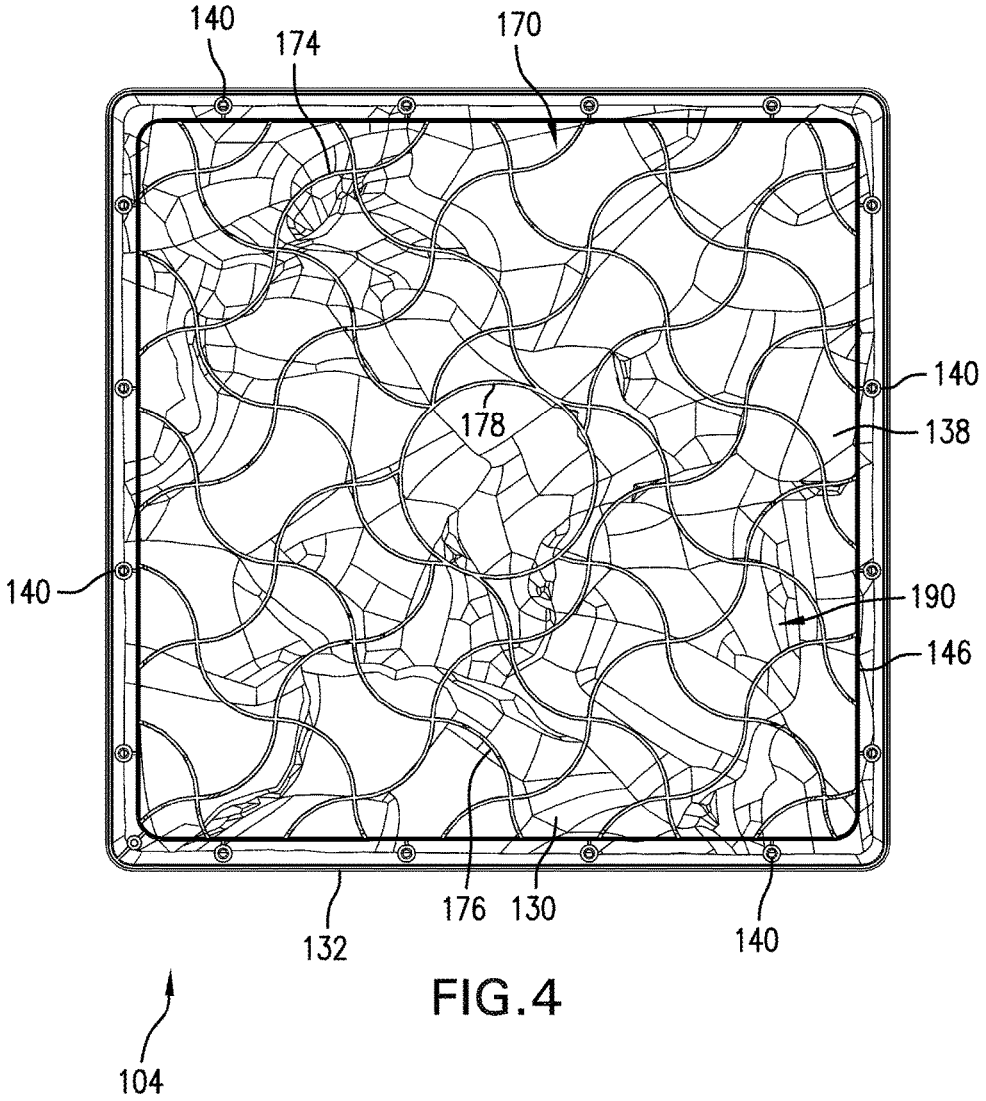
FIG. 4 is a bottom plan view of a top part of the paver of FIG. 1.
Figure 5:
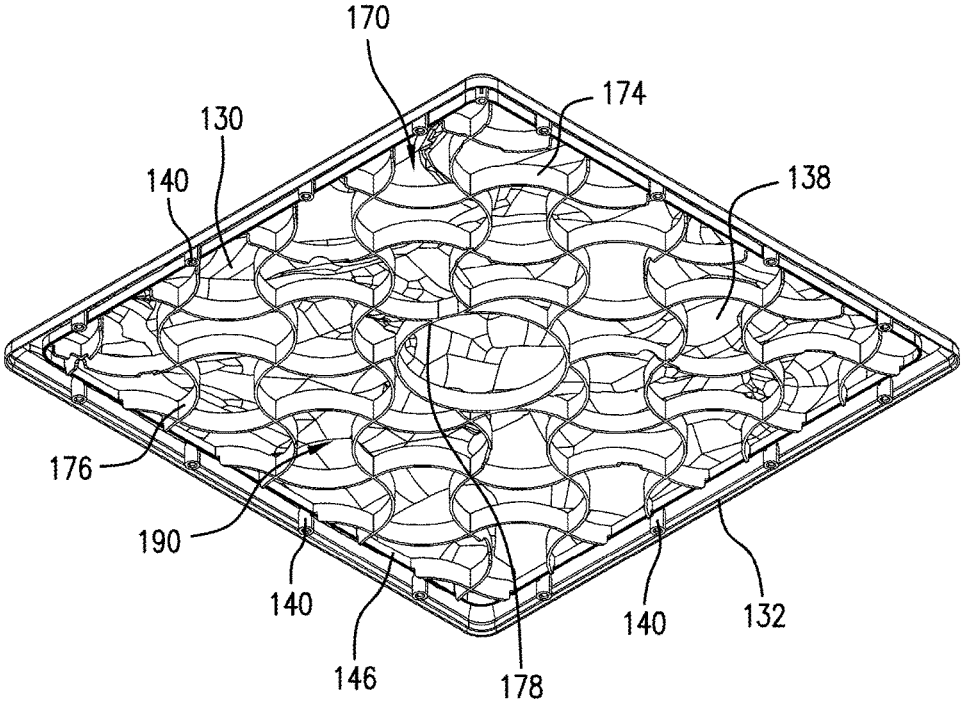
FIG. 5 is a bottom perspective view of the top part of FIG. 4.

In the depicted embodiment, the inner surface 138 of the top part 104 includes a plurality of first strengthening ribs 170 and the inner surface 158 of the bottom part 106 includes a plurality of second strengthening ribs 172. With particular reference to FIGS. 4 and 5, the plurality of first strengthening ribs 170 is defined by a first set of strengthening ribs 174, a second set of strengthening ribs 176, and a strengthening rib 178, which is centrally located on the inner surface 138. Each of the strengthening ribs 174, 176 has one end connected to the mounting flange 146 and an opposite connected to the mounting flange 146 or the strengthening rib 178. According to one aspect, the first set of strengthening ribs 174 have a first orientation in plan view and the second set of strengthening ribs 176 have a second orientation in plan view which differs from the first orientation. In the depicted embodiment, the strengthening ribs 174, 176 are canted or angled relative to the side wall 132 with the strengthening ribs 176 intersecting the strengthening ribs 174. Although, it should be appreciated that alternative orientations for the strengthening ribs 174, 176 are contemplated, the layout of the strengthening ribs 174, 176 being at least partially dependent on the desired aesthetic pattern of light to pass through the outer surface 136 of the top part 104. Further, the strengthening ribs 174, 176 can be curved shaped in plan view, and the strengthening rib 178 can be circular shaped in plan view. According to one aspect, the strengthening ribs 174, 176 can be serpentine (e.g., wave or sinusoidal) shaped with the intersecting strengthening ribs 174, 176 defining curvilinear rectangular shaped reflecting regions 190 on the top part 104 (the reflecting regions 190 defined by a pair of outwardly curved sides and a pair of inwardly curved sides). By providing the strengthening ribs 174, 176 to be curved shaped in plan view, light reflected from the strengthening ribs 174, 176 directed toward the decorative outer surface 136 of the top part 104 is distributed in a more haphazard fashion as compared to if the strengthening ribs were provided in a rectangular grid.

Figure 6:
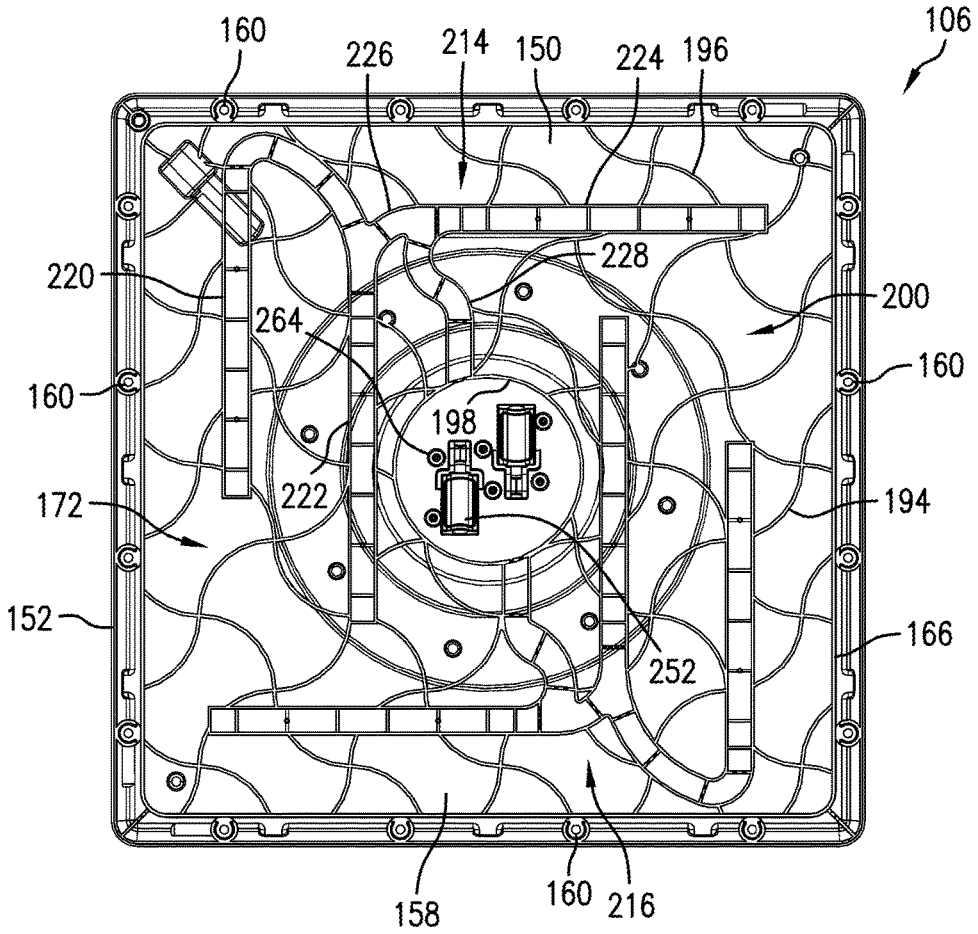
FIG. 6 is a top plan view of a bottom part of the paver of FIG. 1.
Figure 7:
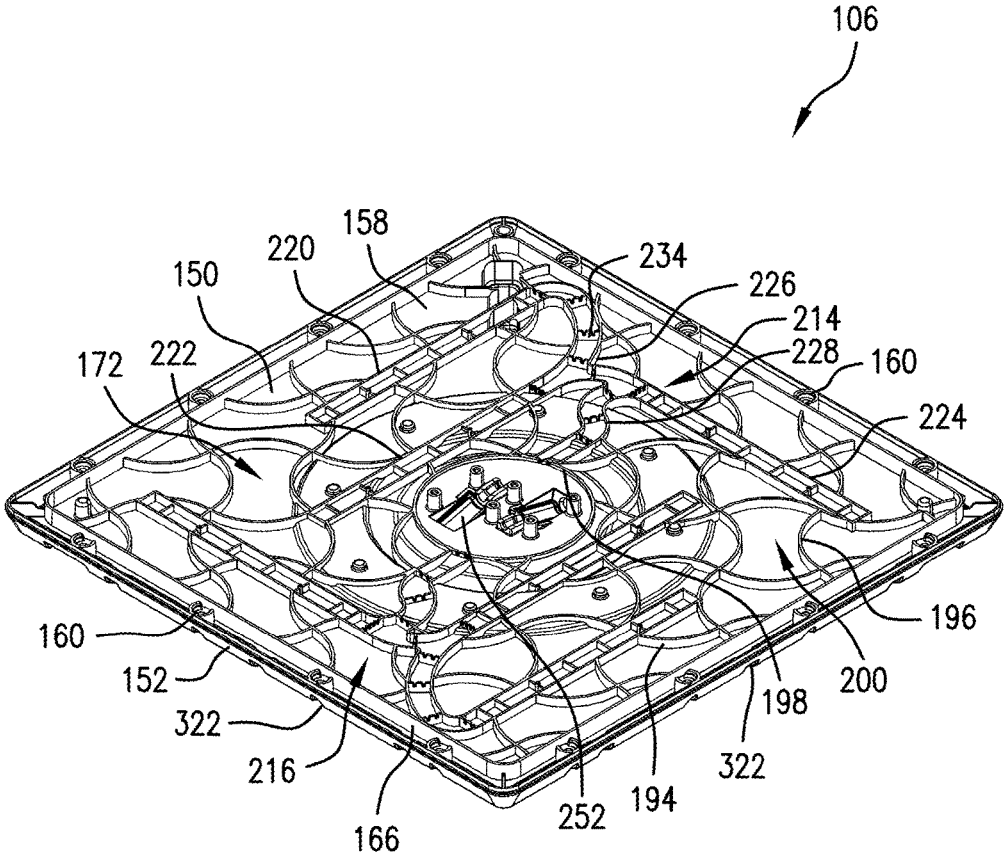
FIG. 7 is a top perspective view of the bottom part of FIG. 6.

With reference to FIGS. 6 and 7, a majority of the plurality of second strengthening ribs 172 correspond in both shape and location on the bottom part 106 with a majority of the plurality of first strengthening ribs 170 on the top part 104. In the depicted aspect, the plurality of second strengthening ribs 172 can be a mirror image of the plurality of first strengthening ribs 170. Accordingly, the plurality of second strengthening ribs 172 is defined by a first set of curved shaped strengthening ribs 194, a second set of curved shaped strengthening ribs 196, and a circular shaped strengthening rib 198, which is centrally located on the inner surface 158. Each of the strengthening ribs 194, 196 have one end connected to the mounting flange 166 and an opposite connected to the mounting flange 166 or the strengthening rib 198. Similar to the strengthening ribs 174, 176, the strengthening ribs 194, 196 define curvilinear rectangular shaped reflecting regions 200 on the bottom part 106.

As indicated previously, the at least one light source 110 is housed in the paver 100, and according to one aspect the at least one light source is two or more light sources, and more particularly six light sources 110. Although more or less than the shown six light sources 110 is contemplated for illuminated the paver 100. In the depicted embodiment, each of the light sources 110 includes at least one light emitting diode (LED) mounted on an operating support 210 secured to the bottom part 106. According to one aspect, each light source 110 includes two LEDs. However, the light sources 110 can be any light source suitable for providing light toward the outer surface 136 of the top part 104. LED light sources, however, typically generate a cone of light having a narrow cone angle, which could result in "hot spots" on the top surface 136, especially since the overall height of the paver 100 is relatively short as compared to know illuminated pavers. The strengthening ribs 170, 172 are configured to reflect and refract light emitted from the light source 110 so as to randomly disperse and diffuse light passing through the decorative outer surface 136 of the top part 104, which can mitigate the "hot spots" issue. The strengthening ribs 170, 172 reflect and refract light emitted from each LED, which can effectively widen the viewing angle of light emitted from each LED. It should be appreciated that light pattern can be dependent on proximity of the LEDs to the strengthening ribs 170, 172. And in the depicted aspect, the placement of the light sources 110 is designed so that certain LEDs are closer to the strengthening ribs 170, 172, certain LEDs are farther from the strengthening ribs 170, 172, and certain LEDs are positioned under the strengthening ribs 170.

The operating support 210 can be in the form of a printed circuit board (PCB) having electrical connections (e.g., simple wiring) provided in or on the operating support 210 for the LED. As best depicted in FIGS. 6 and 7, the inner surface 158 of the base 150 of the bottom part 106 includes first and second mounting frameworks 214, 216 for the light sources 110 which are at least partially surrounded by the second strengthening ribs 172. By way of example, with the depicted six light sources 10, each mounting framework 214, 216 has secured thereto three light sources 110. The first framework 214 includes first section 220, a second section 222 arranged parallel to the first section 220, and a third section 224 arranged transverse to the first section 220. Each of the sections 220, 222, 224 has one of the light sources 110 mounted thereto. The first framework 214 further includes a first connecting section 226 interconnecting the sections 220, 222, 224 and a second connecting section 228 interconnecting the first connecting section 226 to the central strengthening rib 198. Cutouts 234 are provided in the first framework 214 to facilitate electrical connection between the light sources 110. As depicted, the second framework 216 is configured similar to the first framework 214, and therefore, further discussion of the second framework 216 is omitted for conciseness. Again, the configuration of each of the first and second frameworks 214, 216 is dependent on the number of light sources 110 to be housed in the paver body 102.

With reference back to FIGS. 2 and 3, an electrical cord receptacle 240 is attached to the base inner surface 158 of the bottom part 106 via suitable fasteners 242 (e.g., screws) which extend though mounting apertures 244 in the receptacle 240 and threading engage mounting bosses 248 on the inner surface 158. In its attached condition, the receptacle 240 is surrounded by the central strengthening rib 198. The receptacle 240 is configured to at least partially house strain relief grommets or bushings 250 for the electrical cord 114, which are also received in correspondingly shaped recesses 252 formed on the inner surface 158.

Figure 10:
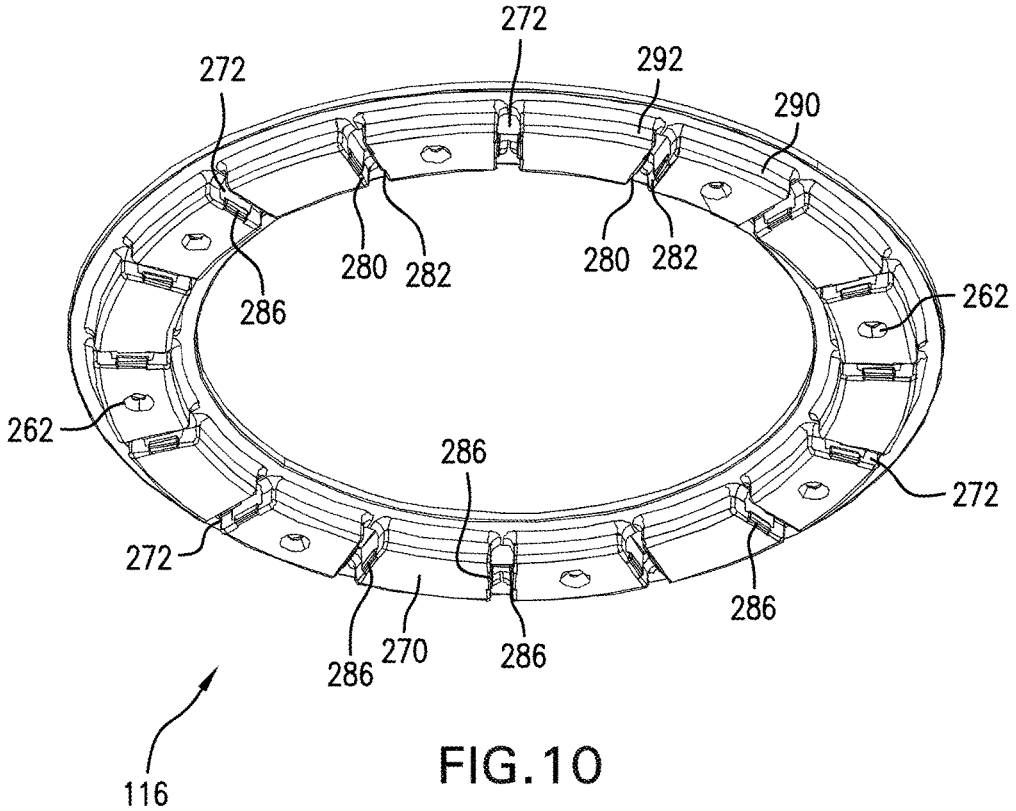
FIG. 10 is a perspective view of a cord wrap of the paver of FIG. 1.

FIGS. 2, 3 and 10 depict the exemplary cord wrap 116 provided on the bottom surface 156 of the bottom part 106. According to one aspect, the cord wrap 116 is a separate component of the paver 100 attached to the bottom surface 156. As shown, suitable fasteners 260, such as screws, extend through mounting apertures 262 located on the cord wrap 116 and threadingly engage mounting bosses 264 provided on the bottom surface 156. Although, it should be appreciated that alternative manners for attaching the cord wrap 116 to the bottom part 106 are contemplated. Further, it should be appreciated that the cord wrap 116 can be integrally formed with the bottom part 106. The cord wrap 116 includes a body 270 having a plurality of cord receiving recesses 272 defined therein. To maintain the electrical cord 114 within a selected recess 272, at least one of opposed walls 280, 282 of the body 270 that form each of the recesses 272 includes a protuberance 286 extending toward the other wall which reduces the size of the opening into each recess 272. As shown, each of the walls 280, 282 can include a protuberance 286. According to one aspect, the cord wrap 116 is substantially ring shaped and surrounds the electrical cord receptacle 240 located on the bottom part 106, and the recesses 272 are equally spaced on the cord wrap 116. Although, alternative shapes (e.g., polygonal shapes) for the cord ward 116 are contemplated. The exemplary cord wrap 116 further includes a channel 290 extending about its outer periphery and sized to receive the electrical cord 114. In the illustrated embodiment, the channel 290 is provided on a side wall 292 of the body 270 and the recesses 272 intersect the channel 290. With this arrangement, the electrical cord 114 extending into and out of the bottom part 106 can be selectively positioned in at least one of the recesses 272 and wound around the body 270 of the cord wrap 116 via the outer channel 290.

Figure 8:
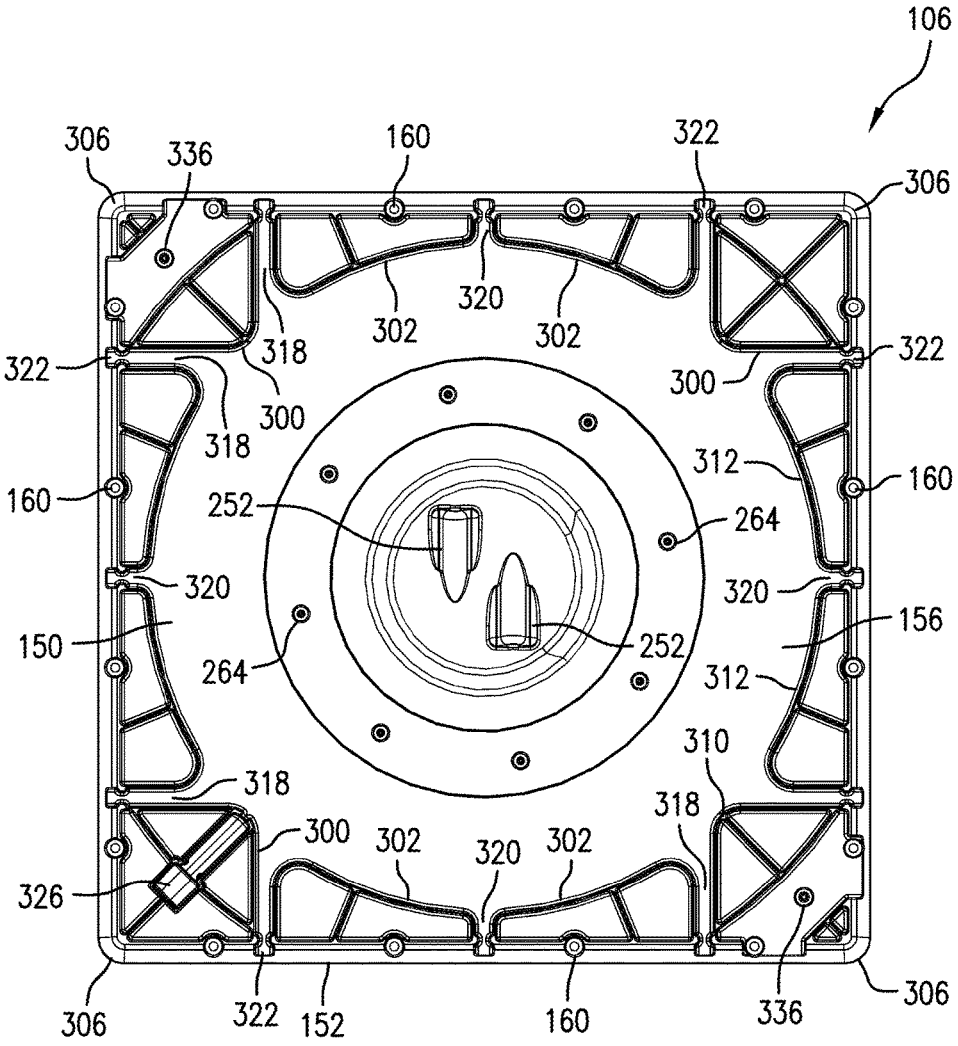
FIG. 8 is a bottom plan view of the bottom part of the paver of FIG. 6.
Figure 9:
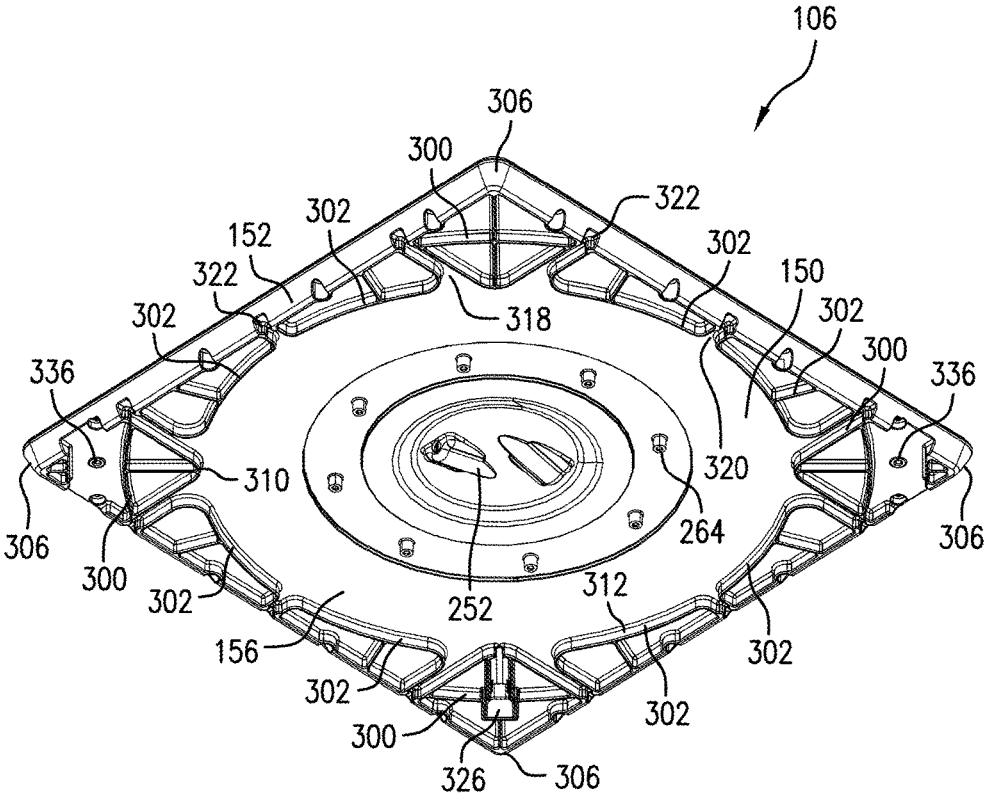
FIG. 9 is a bottom perspective view of the bottom part of FIG. 6.

With particular reference to FIGS. 8 and 9, further provided about the periphery of the base bottom surface 156 of the bottom part 106 are a plurality protruding portions 300, 302. The protruding portions 300 are located in corners 306 of the bottom part. A pair of protruding portions 302 are located along the side wall 152 of the bottom part 106 between the protruding portions 300. In plan view, the protruding portions 300, 302 are shaped such that sections 310, 312 of the respective protruding portions 300, 302 facing the cord wrap 116 generally conform to the shape of the cord wrap 116. By way of example, with the ring shaped cord wrap 116 the protruding portions 300 are generally triangular shaped and the protruding portions 302 are generally ramped shaped, and when viewed together in plan view the sections 310, 312 form a circle. Again, it should be appreciated that the protruding portions 300, 302 can have alternative shapes to correspond to an alternative shaped cord wrap 116. The protruding portions 300, 302 are spaced a predetermined distance from one another such that adjacent protruding portions 300, 302 and 303, 302 define respective electrical cord routing channel 318, 320 which allows the electrical cord 114 to be routed along multiple places about the perimeter of the paver 100. The channels 318, 320 are aligned with cutouts 322 arrayed along the side wall 152 of the bottom part 106. In addition, the protruding portions 300, 302 together with the cord wrap 116 and side wall 152 define a bottom support surface for the paver 100. The bottom surface 156 of the bottom part 106 further includes a socket 326 dimensioned to at least partially receive and store a female end (not shown) of the electrical cord 114. As shown, the socket 326 can be located at one of the corners 306 and is at least partially defined in the protruding portion 300 located in that corner 306.

With reference back to FIGS. 1-3, the paver 100 further includes at least one foot 330 located on the bottom part 106 and extending outwardly therefrom. The at least one foot 330 is configured to cooperate with an associated ground stake (not shown) to further secure the paver 100 in the ground. In the depicted embodiment, a pair of feet 330 is provided at opposite corners 306 of the bottom part 106. The feet 330 can be attached to the base bottom surface 156 via suitable fasteners 332 (e.g., screws) which extend through mounting apertures 334 and threadingly engage holes 336 located in the corners 306. The feet 330 can each include holes 338 to receive an associated ground stake.

Figure 11:
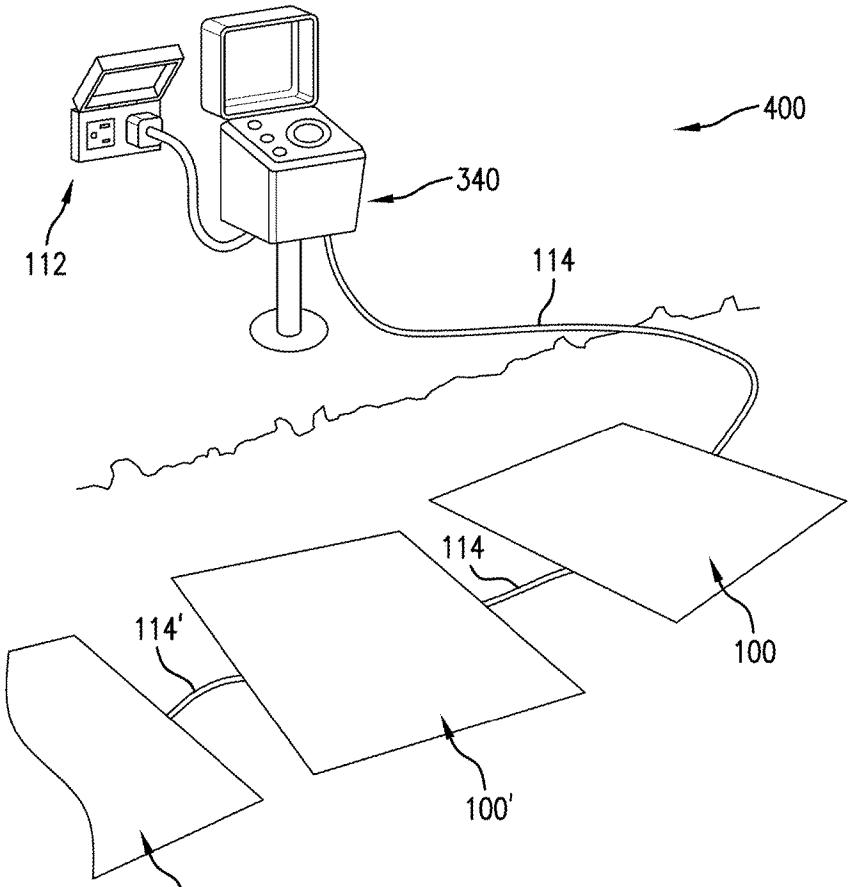
FIG. 11 is a schematic view of an exemplary illuminated paver system according to the present disclosure.
Figure 12:
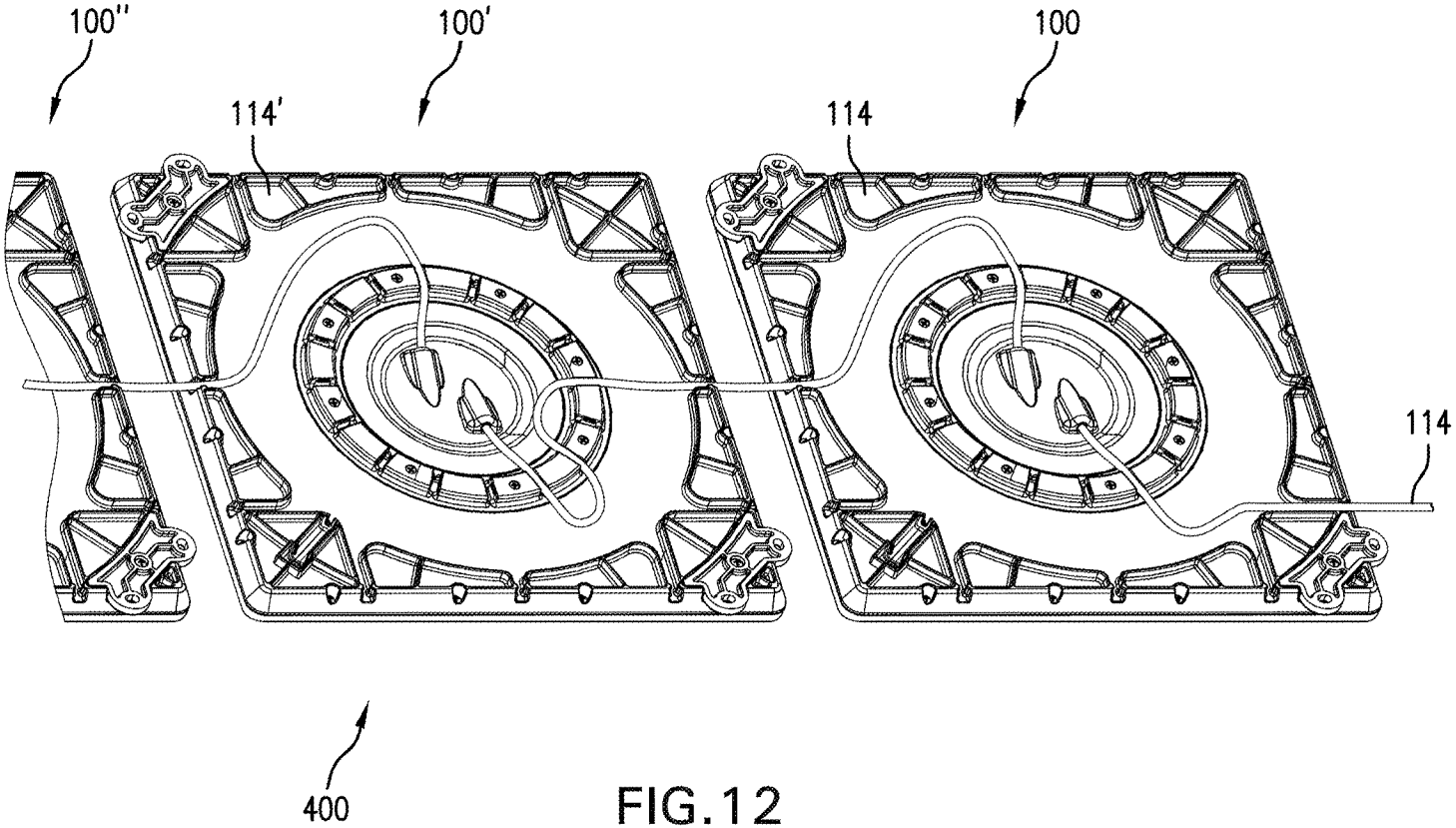
FIG. 12 is a bottom perspective view showing a connection between first and second pavers of the system of FIG. 11.

FIGS. 11 and 12 illustrate an illuminated paver system 400 according to the present disclosure. The system 400 generally comprises a first illuminated paver 100 and a second illuminated paver 100' electrically connected together to form a walkway, or lighting for other surfaces as desired. The pavers 100, 100' are designed to be connected in parallel to the same external power source 112. The electrical cord 114 is at least partially housed in the body 102 of the first paver 100, for electrically connecting the first paver to the external power source 112 and the second paver 100'. The electric cord 114' is at least partially housed in the body 102' of the second paver 100' for electrically connecting the second paver to a third illuminated paver 100", if desired. The electrical cords 114 of the pavers are connected together using standard wiring practices. The cord wrap 116 includes the plurality of recesses 272 for selectively receiving the electrical cord 114 thereby allowing for adjustment of a distance between the first and second pavers. Adjacent protruding portion 300, 302 define electrical cord routing channels 318, 320 which allow the electrical cord 114 to extend from multiple locations about a periphery of the first paver 100 thereby allowing for multiple orientations of the second paver 100' relative to the first paver 100. The light sources of the pavers can be controlled manually at a control box 340 and/or remotely, e.g., by a smartphone. The system 400 contemplates multiple pavers being combined and interconnected to create large arrays or displays within a surface, with the multiple pavers connected to the same external power source.

The paver 100 of the present disclosure is formed of a moldable material (e.g. a plastic material) and may be of virtually of any shape. In the depicted embodiment, the paver 100 has a substantially square shape and includes rounded corners 306. The material for the paver 100 can be colored in manufacturing with the addition of pigments to achieve desired architectural or artistic goals. In addition, the top surface 136 of the top part 104 is at least partially transparent, and may be molded to include surface textures and patterns, such as, by way of example, simulating cobblestone, brick, fieldstone, broken granite, smooth soapstone or the like.

It will be appreciated that the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An illuminated paver comprising:

a body including a top part having a decorative outer surface and a separate bottom part attached to the top part;

a light source housed in the body and configured to be electrically connected to an associated external power source; and a plurality of strengthening ribs extending between the top and bottom parts of the body, the strengthening ribs configured to reflect light emitted from the light source so as to randomly disperse light passing through the decorative outer surface, wherein the light source is a plurality of light sources mounted to a framework located in the bottom part, the framework including cutouts to facilitate electrical connection between the light sources.

2. The illuminated paver of claim 1, wherein the plurality of strengthening ribs are curved shaped in plan view.

3. The illuminated paver of claim 2, wherein an inner surface of the top part includes a plurality of first strengthening ribs and an inner surface of the bottom part includes a plurality of second strengthening ribs.

4. The illuminated paver of claim 3, wherein a majority of the second strengthening ribs correspond in both shape and location on the bottom part with a majority of the first strengthening ribs on the top part.

5. An illuminated paver comprising:

a body including a top part having a decorative outer surface and a separate bottom part attached to the top part;

a light source housed in the body and configured to be electrically connected to an associated external power source;

a plurality of strengthening ribs extending between the top and bottom parts of the body, the strengthening ribs configured to reflect light emitted from the light source so as to randomly disperse light passing through the decorative outer surface, and at least one foot located on the bottom part and extending outwardly therefrom, the at least one foot adapted to have mounted thereto an associated stake.

6. An illuminated paver comprising:

a body including a top part having a decorative outer surface and a separate bottom part attached to the top part;

a light source housed in the body and configured to be electrically connected to an associated external power source;

a plurality of strengthening ribs extending between the top and bottom parts of the body, the strengthening ribs configured to reflect light emitted from the light source so as to randomly disperse light passing through the decorative outer surface, and an electrical cord wrap provided on an outer surface the bottom part and including a plurality of cord receiving recesses.

7. The illuminated paver of claim 6, wherein the cord wrap is a separate component attached the bottom part.

8. The illuminated paver of claim 6, wherein the cord wrap includes a channel extending about its periphery, the recesses intersecting the channel.

9. The illuminated paver of claim 6, wherein an outer surface of the bottom part includes a plurality protruding portions, adjacent protruding portions defining an electrical cord routing channel, the protruding portions provided about a periphery of the bottom part.

10. The illuminated paver of claim 6, wherein an outer surface of the bottom part includes a socket dimensioned to at least partially receive and store a female end of an electrical cord at least partially housed in the body.

11. The illuminated paver of claim 7, wherein the cord wrap is substantially ring shaped and surrounds an electrical cord receptacle located on the bottom part, and the recesses are equally spaced on the cord wrap.

12. An illuminated paver comprising:

a body including a top part having a decorative outer surface and a separate bottom part attached to the top part;

a light source housed in the body;

an electrical cord at least partially housed in the body for electrically connecting the light source to an associated external power source; and a cord wrap provided on an outer surface the bottom part and including a plurality of recesses for selectively receiving the electrical cord.

13. The illuminated paver of claim 12, wherein the cord wrap includes a cord receiving channel extending about its periphery, the recesses intersecting the channel.

14. The illuminated paver of claim 12, wherein the outer surface of the bottom part includes a plurality protruding portions separate from the cord wrap, adjacent protruding portions defining an electrical cord routing channel, the protruding portions together with the cord wrap defining a bottom support surface for the paver.

15. The illuminated paver of claim 12, wherein an inner surface of at least one of the top part and the bottom part of the body includes a plurality of strengthening ribs extending between the top and bottom parts, the strengthening ribs configured to reflect light emitted from the light source so as to randomly disperse light passing through the decorative outer surface.

16. The illuminated paver of claim 12, further comprising at least one foot located on the bottom part and extending outwardly therefrom, the at least one foot adapted to have mounted thereto an associated stake.

17. An illuminated paver system comprising:

a first illuminated paver including:

a body including a top part having a decorative top surface and a bottom part, a light source housed in the body, a plurality of internal strengthening ribs extending between the top part and the bottom part of the body, the strengthening ribs configured to reflect light emitted from the light source so as to randomly disperse light passing through the decorative top surface, an electrical cord at least partially housed in the body for electrically connecting the light source to an associated external power source and to another light source in a second illuminated paver, and a cord wrap including a plurality of recesses provided on the bottom surface for selectively receiving the electrical cord thereby allowing for adjustment of a distance between the first and second pavers.

18. The illuminated paver system of claim 17, wherein the bottom surface includes a plurality protruding portions separate from the cord wrap, adjacent protruding portions defining an electrical cord routing channel, the protruding portions configured to allow the electrical cord to extend from multiple locations about a periphery of the first paver thereby allowing for multiple orientations of the second paver relative to the first paver.

19. The illuminated paver system of claim 17, wherein the second paver is configured identical to the first paver.

* * * * *